United States Patent [19]

Schmuck et al.

[11] 4,303,456

[45] Dec. 1, 1981

[54] PROCESS FOR THE CONTINUOUS PRODUCTION OF WET FOAM LAMINATED FABRICS

[75] Inventors: Günter Schmuck, Greenville, S.C.; Dieter Wegehaupt, Rheinfelden, Switzerland

[73] Assignee: Ciba-Geigy Corporation, Ardsley, N.Y.

[21] Appl. No.: 150,035

[22] Filed: May 15, 1980

[30] Foreign Application Priority Data

May 23, 1979 [CH] Switzerland ..... 4840/79

[51] Int. Cl.[3] ..... B32B 31/20; B32B 5/18; C08L 67/08

[52] U.S. Cl. ..... 156/78; 156/164; 156/324; 156/331.3; 156/332; 252/8.6; 260/29.6 NR; 260/29.6 HN; 260/29.6 N; 260/29.6 MN; 427/244; 427/389.9; 428/246; 428/261; 428/290; 428/310

[58] Field of Search ..... 8/477; 156/78, 164, 156/229, 307.1, 307.3, 324, 331.3, 332; 252/8.6, 307, 321; 264/50, 45.1, 54; 260/29.6 H, 29.6 N, 29.6 HN, 29.6 MN, 29.6 NR; 427/244, 246, 389.9, 394; 428/246, 261, 290, 310

[56] References Cited

U.S. PATENT DOCUMENTS

| | | | |
|---|---|---|---|
| 3,519,459 | 7/1970 | Hofmann et al. | 264/49 X |
| 3,713,868 | 1/1973 | Gordon et al. | 428/254 |
| 3,732,184 | 5/1973 | Lindemann et al. | 526/87 X |
| 3,740,353 | 6/1973 | Patrick et al. | 260/29.6 NR X |
| 3,907,736 | 9/1975 | Barton et al. | 428/254 X |
| 4,070,325 | 1/1978 | Burke | 260/29.6 NR X |
| 4,110,288 | 8/1978 | Schirmann et al. | 260/29.6 NR X |
| 4,159,355 | 6/1979 | Kaufman | 428/290 X |

FOREIGN PATENT DOCUMENTS

| | | |
|---|---|---|
| 2412028 | 9/1975 | Fed. Rep. of Germany . |
| 2745950 | 4/1978 | Fed. Rep. of Germany . |
| 2367608 | 5/1978 | France . |

*Primary Examiner*—Robert A. Dawson

*Attorney, Agent, or Firm*—John P. Spitals; Edward McC. Roberts

[57] ABSTRACT

A process for the continuous production of laminated elastic fabrics having good permeability to air and/or water vapor, which comprises coating a first web of fabric in the tensionless state with a foamed aqueous preparation which contains a self-crosslinking copolymer, e.g. based on acrylate, optionally a curable, crosslinking polyfunctional aminoplast precondensate or aminoplast former, a surface-active foaming agent and a stabilizer as well as, optionally, further assistants, wet bonding a second web of fabric, optionally under low tension, to the coated side of the first web, then drying both webs and pressing them together and finally subjecting them to a thermosetting treatment.

10 Claims, No Drawings

PROCESS FOR THE CONTINUOUS PRODUCTION OF WET FOAM LAMINATED FABRICS

The present invention relates to a continuous process for the production of wet laminated fabrics, especially elastic fabrics, having good permeability to air and/or water vapour.

It is known to produce laminates from elastic knitted and woven goods, for example by flame-bonding with a polyurethane foam or by paste-bonding. Flame-bonding is understood as meaning the continuous bonding of two textile webs by means of foam sheets, the surface of which acquires adhesive strength when it is passed by gas burners. Disadvantages of this process are that a special assembly is required for carrying out the process and that the desired thicknesses of the foam are not variable as desired. Furthermore, only low adhesion of the polyurethane foam to the fabric is achieved (short life); the heat insulation and the handle of the laminates are, moreover, inadequate.

In paste-bonding, the elasticity of the finished article is determined by the elasticity of the polymer film and as a rule is far below the elasticity of the starting material. In addition to these losses in elasticity, the handle obtained is also not satisfactory. Furthermore, the permeability to air and to water vapour is very low, as a result of which the wearing properties, especially of sportswear articles, are greatly impaired. A further disadvantage of paste-bonding is that it is almost impossible to bond open-structure woven and knitted fabrics, as the paste can very easily strike through.

German Offenlegungsschrift No. 2 745 950, for example, discloses water-resistant, dry laminated products which are produced by applying the foam preparation to a web of fabric and drying it for 1 to 10 minutes initially without heatsetting, crosslinking or vulcanising at 90° to 180° C. until a degree of moisture is attained that the foam is at least stabilised, whereupon another web of fabric is superimposed on, i.e. bonded to, the coated web, and both webs are then pressed continuously together to form a laminate and subjected continuously to a heat treatment. In this process, complicated mechanical procedures are necessary (use of heated calenders).

Accordingly, it is the object of the present invention to provide a novel process for the continuous production of wet laminated elastic fabrics, by means of which process the elasticity of the starting article is retained, the fabrics obtained have good heat insulation, a particularly soft handle and also good permeability to air and water vapour, and good adhesion between the coating and the fabric is also obtained.

The above object is attained according to the invention by using, as laminating agent, a foamed aqueous preparation which contains a self-crosslinking copolymer based e.g. on acrylate and optionally a curable aminoplast precondensate and applying this preparation to a tensionless web of fabric, wet laminating thereto a second web of fabric and then finishing the resultant laminate by subjecting it to a heat treatment and, if desired, a pressure treatment. The preparation is not dried before laminating.

Accordingly, the present invention relates to a process for the continuous production of laminated elastic fabrics having good permeability to air and/or water vapour, which process comprises coating a first web of fabric, in the tensionless state, with a foamed aqueous preparation which contains ($a_1$) a self-crosslinking acrylate-based copolymer, ($a_2$) a self-crosslinking vinyl-acrylate copolymer or ($a_3$) a self-crosslinking olefin-vinyl copolymer, (b) optionally a curable, crosslinking, polyfunctional aminoplast precondensate or aminoplast former, (c) a surface-active foaming agent, (d) a stabiliser, (e) optionally a wetting agent, (f) optionally a thickener, and (g) an amine or alkanolamine containing 1 to 4 carbon atoms or ammonia, bonding a second web of fabric, optionally under low tension, to the coated side of the first web, then drying and optionally pressing both webs together and finally subjecting them to a thermosetting treatment.

The invention also relates to the foamed aqueous preparations of the laminating agents which are suitable for carrying out the process, and to the fabric, preferably elastic fabric, obtained by the process.

The aqueous foamed preparations always contain only one of the three copolymers ($a_1$), ($a_2$) or ($a_3$), as well as always components (c), (d) and (g), whereas components (b), (e) and (f) are optional. Preferred preparations are those which contain optional component (b). Copolymers ($a_2$) and especially ($a_1$) are preferred to copolymer ($a_3$).

The self-crosslinking acrylate-based copolymers used as component ($a_1$) are preferably copolymers of (1) 50 to 95 percent by weight of at least one methacrylic acid ester, preferably acrylic acid ester, containing 1 to 8 carbon atoms in the ester radical, (2) 1 to 40 percent by weight of acrylonitrile, (3) 2 to 10, preferably 2 to 6, percent by weight of an ethylenically unsaturated aliphatic dicarboxylic acid containing 4 to 6 carbon atoms, an ethylenically unsaturated aliphatic monocarboxylic acid containing 3 or 4 carbon atoms and/or the optionally methylated N-methylolamide of these monocarboxylic acids, and (4) 0 to 20 percent by weight of another copolymerisable, unsaturated compound which differs from components (1), (2) and (3).

Suitable acrylates as component (1) are e.g. methyl acrylate, ethyl acrylate, isopropyl acrylate, n-butyl acrylate, isobutyl acrylate, 2-ethylbutyl acrylate or 2-ethylhexyl acrylate, allyl acrylate, benzyl acrylate or tetrahydrofurfuryl acrylate. These acrylates can be used on their own or as mixtures.

Component (3) can be crotonic acid, vinylacetic acid, methacrylic acid, acrylic acid, itaconic acid, citraconic acid or mesaconic acid or also the N-methylolamides or N-methoxymethylolamides of the said monocarboxylic acids. N-Methylolacrylamide and/or, in particular, acrylic acid are of primary interest.

Compounds suitable as component (4), which can, if desired, be admixed with the ternary system ester/nitrile/acid or ester/nitrile/N-methylolamide and copolymerised, are either those which are polymerisable on their own or also those which are not polymerisable on their own. Suitable compounds of the first group are polymerisable, mono- or poly-unsaturated compounds, especially those containing the atom grouping $CH_2=C<$, such as vinyl esters of inorganic or organic acids, for example sodium vinyl sulfate, vinyl acetate, vinyl formate, vinyl butyrate or vinyl benzoate, and also vinyl alkyl ketones, vinyl halides such as vinyl chloride or vinylidene chloride, vinylaryl compounds such as styrene and substituted styrenes, and also compounds of the acrylic acid series other than esters, nitriles or acids, for example acrylamide or methacrylamide or derivatives thereof, and also analogous derivatives of α-chloroacrylic acid.

Examples of compounds which are not polymerisable on their own are: maleic acid, fumaric acid or crotonic acid or their esters or anhydrides such as maleic anhydride, and also unsaturated hydrocarbons, such as camphene, and also unsaturated ethers which are stable to acids, such as isobornyl allyl ether or diallyl ether.

The corresponding amides are preferably employed in combination with N-methylolamides, as the N-methylolamides are usually prepared by partial methylolation of the corresponding amides, so that the amide and N-methylolamide are present as a mixture. The methylol group can always also be in etherified form, i.e. in the form of the methyl ether.

The acrylate-based copolymers ($a_1$) to be used in the practice of this invention are preferably prepared in the presence of emulsifiers. Suitable emulsifiers, with the aid of which the emulsions of the starting materials are prepared, are those which possess adequate stability in an acid medium, for example fatty alcohol sulfuric acid esters, sulfonated castor oil, higher alkylsulfonates, higher oxyalkylsulfonates, especially sodium octadecaneoxysulfonate, preferably that which is free from other salts; sulfodicarboxylic acid esters, for example the sodium salt of dioctyl sulfosuccinate, higher alkylarylsulfonates, and also polyglycol ethers of higher molecular fatty alcohols, such as cetyl alcohol, oleyl alcohol or octadecyl alcohol, for example reaction products of 15 to 30 moles of ethylene oxide with 1 mole of the fatty alcohol. It is also possible to use emulsifiers which have a pronounced wetting action, such as octylphenol polyglycol ethers or alkyl lauryl polyethers, the acid sulfuric acid esters thereof, optionally in the form of their sodium salts and also lauryl alcohol polyglycol ethers. Mixtures of such emulsifiers and also mixtures of such emulsifiers with protective colloids can also be used.

Polymerisation catalysts which can be added are organic or inorganic peroxides or per-salts, for example peracetic acid, acetyl peroxide, benzoyl peroxide, benzoylacetyl peroxide, tert-butyl hydroperoxide, lauroyl peroxide, hydrogen peroxide, percarbonates, persulfates or perborates, which can be used together with e.g. iron(II) sulfate and sodium formaldehyde sulfinate as redox catalysts.

The copolymers used as component ($a_1$) are known, for example, from German Offenlegungsschrift No. 2 744 256 and from U.S. Pat. No. 3,732,184.

Preferred copolymers ($a_1$) contain 70 to 90, in particular 72 to 88% by weight of component (1), 5 to 25, in particular 8 to 22% by weight of component (2), 2 to 8% by weight of component (3) and 0 to 10, in particular 0 to 5%, by weight of component (4).

Particularly suitable copolymers ($a_1$) are obtained from the following monomers (1) 82 to 88% by weight of n-butyl acrylate or isobutyl acrylate, (2) 8 to 12% by weight of acrylonitrile and (3) 4 to 6% by weight of acrylic acid; or (1) 72 to 85% by weight of n-butyl acrylate or n-butyl acrylate/2-ethylhexyl acrylate, (2) 8 to 22% by weight of acrylonitrile and (3) 2 to 6% by weight of N-methylolacrylamide.

The emulsion copolymers can be in partially neutralised form, by carrying out the copolymerisation on the one hand in the presence of small amounts (0.1 to 1%, based on the monomer mixture) of an amine, for example an alkanolamine, such as triethanolamine, and, on the other hand, neutralising the emulsion of the copolymer partially with a base, e.g. with ammonia.

The self-crosslinking copolymers based on vinyl acrylates used as component ($a_2$) are preferably copolymers of (1) 20 to 95% by weight of at least one methacrylic acid ester or acrylic acid ester containing 1 to 8 carbon atoms in the ester radical, (5) 5 to 80% by weight of a copolymerisable vinyl ester of an organic acid containing 1 to 18 carbon atoms, (6) 0 to 10% by weight of at least one optionally methylolated compound of the formula I which can be etherified with alkanols containing 1 to 8, preferably 1 to 4, carbon atoms $$CH_2{=}\overset{\overset{R_1}{|}}{C}{-}A{-}B{-}[{-}R_2{-}O{-}]_{n-1}{-}\overset{\overset{O}{\|}}{C}{-}NH_2 \qquad (I)$$

wherein $R_1$ is hydrogen or methyl, A is methylene or —CO—, B is a direct bond, —O— or —NH—, $R_2$ is alkyl of 2 to 4 carbon atoms, and n is an integer from 1 to 11, preferably 1 to 3, and (7) 0 to 10% by weight of another copolymerisable compound differing from components (1), (5) and (6).

Component (1), specific examples of which have already been given above, can be employed both for obtaining the acrylate-based copolymers used as component ($a_1$) and for obtaining the vinyl acrylate-based copolymers used as component ($a_2$).

Examples of vinyl esters used as component (5) are vinyl formate, vinyl acetate, vinyl propionate, vinyl n-butyrate, vinyl isobutyrate, vinyl hexanoate, vinyl laurate, vinyl n-caproate, vinyl pivalate, vinyl stearate, vinyl isocaproate, vinyl pelargonate, vinyl chloroacetate and vinyl benzoate.

Suitable optional components (6) are in particular acrylamide, methacrylamide, allyl carbamate, methallyl carbamate, allyl urea, and the reaction procucts of these compounds with formaldehyde or acetaldehyde, which can additionally be etherified with alkanols such as methanol, ethanol, n-propanol, isopropanol, n-butanol, isobutanol or tert-butanol. The component (6) optionally employed for the production of copolymer ($a_2$) corresponds partially to the component (3) which is always employed for obtaining copolymer ($a_1$). This applies especially to methylolated components (6).

Compounds suitable for use as component (7), which is optionally mixed and polymerised with the binary system acrylate/vinyl ester or the ternary system acrylate/vinyl ester/methylolamide, are both those which are polymerisable on their own and those which are not polymerisble on their own.

Of the compounds of the first group, acrylonitrile is to be especially mentioned. Further examples of both the compounds which are polymerisable on their own and the compounds which are not polymerisable on their own are identical with the examples given above for component (4). Accordingly, the sole difference between the optional component (7) for obtaining copolymer ($a_2$) and the optional component (4) for obtaining the copolymer ($a_1$) is that component (7) can additionally be acrylonitrile but cannot be a vinyl ester of an organic acid, such as vinyl acetate.

The self-crosslinking olefin/vinyl copolymers used as component ($a_3$) are preferably copolymers of (5) 50 to 90% by weight of a vinyl ester of an organic acid containing 1 to 18 carbon atoms, (8) 10 to 40% by weight of an olefin, and (6) 0 to 10% by weight of a compound of the formula (I) above.

Component (5) and the optional component (6) for obtaining the olefin/vinyl copolymer ($a_3$) have already been described in the production of the vinyl acrylate copolymer ($a_2$). Component (6) is primarily ethylene.

The copolymers based on vinyl acrylates as component ($a_2$) and based on olefin/vinyl compounds as component ($a_3$) are known per se and are prepared in known manner, substantially as described for component ($a_1$), i.e. preferably in the presence of emulsifiers and catalysts of the indicated kind, while for the production of component ($a_3$) it is desirable to apply pressure.

Preferred polymers ($a_2$) contain 30 to 90% by weight, preferably 40 to 85% by weight, of component (1), 10 to 70% by weight, preferably 15 to 60% by weight, of component (5), 0 to 8% by weight, preferably 0 to 6% by weight, of component (6) and 0 to 8% by weight, preferably 0 to 6% by weight, of component (7).

Especially preferred polymers ($a_2$) are obtained from 45 to 83% by weight of n-butyl acrylate, 15 to 55% by weight of vinyl acetate and 2 to 6% by weight of a monomer mixture consisting of acrylamide, N-methylolacrylamide and N-methylolacrylcarbamate, or from 45 to 83% by weight of n-butyl acrylate, 15 to 55% by weight of vinyl acetate, 2 to 6% by weight of N-methylolacrylamide and 0 to 6% by weight of maleic anhydride.

Preferred copolymers ($a_3$) contain 50 to 85% by weight, preferably 55 to 80% by weight, of component (5), 15 to 40% by weight, preferably 20 to 35% by weight, of component (8), and 0 to 10% by weight, preferably 0 to 8% by weight, of component (6).

Especially preferred polymers ($a_3$) are obtained from 55 to 78% by weight of vinyl acetate, 20 to 35% by weight of ethylene and 2 to 8% by weight of alkyl carbamate, or from 55 to 78% by weight of vinyl acetate, 20 to 35% by weight of ethylene and 2 to 8% by weight of N-methylol allyl carbamate.

Compounds suitable for use as optional component (b) of the foamed aqueous preparations are adducts of formaldehyde with methylolatable nitrogen compounds. Examples of methylolatable nitrogen compounds or "aminoplast formers" are: 1,3,5-aminotriazines, such as N-substituted melamines, for example N-butylmelamine, N-trihalomethylmelamines, triazones and also guanamines, for example benzoguanamines, acetoguanamines or diguanamines.

Further suitable compounds are: cyanamide, acrylamide, alkyl- or aryl-ureas and -thioureas, and alkyleneureas or -diureas, for example ureas, thioureas, urones, ethylene ureas, propylene ureas, acetylene diurea, glyoxal monourein, or 4,5-dihydroxy-2-imidazolidone and derivatives thereof, for example 4,5-dihydroxy-2-imidazolidone substituted in the 4-position at the hydroxy group by the radical —$CH_2CH_2$—CO—NH—$CH_2$—OH, or carbamates of lower alkanols, such as methyl carbamate, ethyl carbamate or hydroxyethyl carbamate.

It is preferred to use the methylol compounds of urea, of ethyleneurea or in particular of melamine.

Valuable products are in general obtained both with completely methylolated products and with products which are only partially methylolated, for example with etherified or non-etherified methylolmelamines, such as di- or tri-methylolmelamine, or the corresponding ethers thereof, such as the alkyl ethers containing 1 to 4 carbon atoms in the alkyl moiety, for example the n-butyl ether, isopropyl ether, n-propyl ether or ethyl ether or, in particular, the methyl ether. Suitable aminoplast precondensates are not only predominantly monomolecular compounds but also more highly pre-condensed products.

Non-methylolated aminoplast formers of the indicated kind, especially glyoxal monourein, can also be used as component (b).

The indicated aminoplast formers and aminoplast precondensates form the essential constituents of many commercially available anticrease agents, so that, in the present instance, the terms aminoplast resins (aminoplast precondensates and aminoplast formers) as well as anticrease agents may be employed in connection with component (b).

Components (c) and (d) are the foam components, and the stabiliser (d), like the wetting agents and thickeners which can be used concurrently if desired, can improve the stability of the foams to such an extent that, in particular, a homogeneous and uniform coating of the first web of fabric can be obtained.

Any surfactant which can form a stable foam can be used as the foaming agent. The preparation is foamed in a conventional foaming device using air or another inert gaseous material.

Preferred foaming agents (c) are $C_8$–$C_{24}$ fatty alcohols which can be ethoxylated, alkylarylsulfonic acids containing 4 to 18 carbon atoms in the alkyl moiety, alkylsulfonic acids and alkyl sulfates containing 8 to 24 carbon atoms and fatty alcohol/ethylene oxide adducts or $C_4$–$C_{12}$alkylphenol/ethylene oxide adducts which are esterified with sulfuric acid or phosphoric acid and which contain 5 to 100 ethylene oxide units, or the alkali metal salts or ammonium salts thereof.

The fatty alcohol can be saturated or unsaturated and it contains 8 to 24 and preferably 12 to 22 carbon atoms. Examples of such alcohols are: octanol, decanol and also lauryl alcohol, myristyl alcohol, cetyl alcohol, stearyl alcohol, arachyl alcohol or behenyl alcohol or oleyl alcohol. The ethoxylated alcohols are preferably employed and the preferred degree of ethoxylation is 10 to 100, in particular 10 to 30.

The alkylarylsulfonic acids are as a rule monosulfonic acids of naphthalene or, in particular, benzene, which is substituted by alkyl having 4 to 18 carbon atoms. Alkylphenylsulfonic acids containing 8 to 12 carbon atoms in the alkyl moiety are especially preferred. Alkylsulfonic acids and alkyl sulfates as a rule contain 8 to 24 carbon atoms in the alkyl moiety, for example sodium laurylsulfonate or sodium stearylsulfonate or, in particular, sodium laurylsulfate or sodium stearylsulfate. The fatty alcohol/ethylene oxide adducts or $C_4$–$C_{12}$alkylphenol/ethylene oxide adducts esterified with phosphoric acid and, in particular, with sulfuric acid, are reaction products of fatty alcohols containing 8 to 24, preferably 12 to 22, carbon atoms (as indicated) or of phenols substituted by straight-chain or branched alkyl containing 4 to 12 carbon atoms (n-butyl, n-hexyl, n-octyl, iso-octyl, tert-octyl, n-nonyl, iso-nonyl, tert-nonyl, n-decyl or n-dodecyl) and ethylene oxide (5 to 100 moles) which are subsequently esterified and, if desired, converted into the corresponding alkali metal salts or ammonium salts.

Examples of suitable stabilisers (d) are ammonium salts or amine salts of fatty acids containing 8 to 24 carbon atoms or fatty acid/alkanolamine reaction products. The salts of fatty acids are as a rule lithium, sodium, potassium, ammonium, monoethanolamine, diethanolamine, triethanolamine or isopropanolamine salts of, for example, caprylic acid, capric acid, lauric acid, myristic acid, palmitic acid, stearic acid, arachic acid, behenic acid, lignoceric acid, oleic acid, linoleic acid, linolenic acid, arachidonic acid or coconut fatty acid. Amine salts and ammonium salts are preferred.

The fatty acid/alkanolamine reaction products are products which are obtained from fatty acids containing 8 to 24 carbon atoms, such as those already indicated above, and alkanolamines containing 2 to 6 carbon atoms, such as ethanolamine, diethanolamine, isopropanolamine or diisopropanolamine.

Examples of such reaction products are coconut fatty acid diethanolamide and lauric acid diethanolamide or stearic acid diethanolamide.

Preferred wetting agents used as optional component (e) are ethoxylated fatty alcohols containing 8 to 24 carbon atoms or alkylphenols containing 4 to 12 carbon atoms in the alkyl moiety. The degree of ethoxylation is usually 1 to 9.

The presence of the optional wetting agent can be important if the foaming agent employed forms a stable foam but is a relatively poor wetting agent, so that the foam is not applied sufficiently uniformly to the substrate, resulting in an impairment in the quality of the laminated goods.

The amount of wetting agents—if used—can be e.g. 0.01 to 1% by weight, based on the total preparation.

The optional component (f) comprises thickeners, for example unmodified or modified cellulose (alkylcelluloses or hydroxyalkylcelluloses), polyvinyl alcohols, alginates or locust bean gums. The thickeners can likewise be used for stabilising the foamed preparations.

Components ($a_1$), ($a_2$), ($a_3$) and (b) to (f) are compounds and products known to those skilled in the art.

The aqueous to foaming preparations must be made slightly alkaline with component (g). Component (g) can be e.g. dibutylamine, preferably triethanolamine and, most preferably, ammonia. As component (g) it is preferred to use the same weak base optionally employed for neutralising the emulsion polymers ($a_1$), ($a_2$) or ($a_3$).

The foams to be used in the practice of this invention can also contain further additives, such as urea, oxidising agents, solvents (for example diethylene glycol monobutyl ether or 2-butoxyethanol) or emulsifiers.

The foamed aqueous preparations ordinarily contain 10 to 60% by weight of one of components ($a_1$), ($a_2$) or ($a_3$), 0 to 10%, preferably 1 to 10% by weight of component (b), 0.1 to 5% of component (c), 0.1 to 5%, preferably 1.5 to 5% by weight of component (d), 0 to 1% by weight of each of components (e) and (f), and 0.1 to 1% by weight of component (g).

The foams are preferably produced mechanically by means of high-speed stirrers, mixers or special foam pumps, with which latter the foams can also be produced continuously. It has proved advantageous to pre-dissolve or predisperse the individual components before they are fed to the foaming apparatus. If desired, the foams can also be produced with the aid of conventional blowing agents.

It has proved advantageous first to mix components (c), (d) and, optionally, (e) with one another and to dissolve them and thus to obtain aqueous solutions containing 2 to 60 percent by weight of foaming components. It is also possible to mix the components with one another without the addition of water, but in the presence of an organic solvent. The other components are then added.

In the practice of the invention, degrees of foaming, i.e. volume ratios of unfoamed to foamed formulation, of 1:6 to 1:20 and preferably 1:8 to 1:15 have been found suitable.

The foams used in the practice of this invention are distinguished by density and stability. The bubble diameters in the foams are about 1 to 100 μm. The foam density can be between 5 and 300 g/l, preferably between 10 and 200 g/l and in particular between 100 and 200 g/l. Especially stable foams are obtained by using 1.5 to 5% by weight of component (d) in the aqueous preparations.

The foamed aqueous preparations (foams) are applied at room temperature or slightly elevated temperature, i.e. usually in the temperature range from 15° to 40° C.

Coating installations with a laminating device, for example calenders, bonding machines or stenter frames, are used for this purpose. The foam is sprayed or atomised onto the webs of fabric and then spread with a coating device (doctor) to give a uniform coating (thickness about 0.5–3 mm).

As highly elastic fabrics are preferably used, it is important that coating and laminating are effected in the same units in a single operation, in order, for example, to avoid high mechanical stresses on the webs (when changing units).

In detail, the process of the invention comprises the following process steps: a first web of fabric passes tensionless through the coating unit, the foam is applied with a doctor, a second web (optionally under only slight tension or, preferably, also tensionless) runs parallel to the first web and is wet laminated to the coated side of the first web at 15° to 40° C. by applying slight pressure, both webs are then dried, for example at temperatures of up to 100° C. and then the webs are pressed together mechanically, for which a linear pressure of 5 to 15 kg/cm suffices, and the laminated product is finally cured, for which temperatures in the range from about 100° to 180° C. are required.

If relatively high temperatures (100° to 160° C.) are used for drying, then the laminating agent undergoes a partial condensation reaction in this stage of the process. Curing is then carried out in the customary manner. In this process variant it is not necessary to press the two webs together. Laminated fabrics which are distinguished by particularly high permeability to air and water vapour are obtained in this way.

Drying and curing of the treated substrate can be effected by the action of heat or by means of nonionising or ionising radiation. All known heat or radiation treatments can be employed for this purpose.

Accordingly, it is possible to use IR lamps, hot gases, ovens, heated rollers or similar conventional means of heating for drying or for curing by the action of heat. Curing by means of radiation can be effected by UV radiation, gamma radiation, electron beam radiation or similar conventional means.

The substrates used are as a rule woven fabrics, knitted fabrics and nonwovens which have a certain elasticity. These substrates can be produced from all of the conventional natural and synthetic fibre materials, such as glass fibres, cotton, linen, regenerated cellulose, cellulose acetate (2½-acetate or triacetate), polyester, polyacrylonitrile, polyamide, polyurethane, wool, silk or polyolefins, especially polypropylene, or in particular from blends of different fibres, while blends of elastic polyurethane fibres (3–30) with cotton, polyester or synthetic polyamide fibres (70–97) are preferred. The web of fabric which is bonded to the coated web can differ from this latter (1st web). The substrates can be dyed or printed.

If desired, the substrates can also be impregnated with agents for improving the wearing characteristics before curing is carried out. This can be accomplished by impregnating the textile laminates, e.g. by slop-padding, spraying or preferably padding, usually at room temperature. Such agents are, in particular, water repellents and/or oil repellents, for example aqueous silicone oil emulsions, organic solutions of organopolysiloxanes, fat-modified melamine resins, fluorine chemicals or water-soluble chromiun complexes of stearic acid. Such coatings have good stability to dry-cleaning. Even if a certain degree of impermeability to water is lost, webs of fabric additionally impregnated with water repellents retain the hydrophobic effect.

Further agents for improving the wearing characteristics are, for example flame retardants, bacteriostatic agents, non-iron or wash-and-wear preparations, fabric softeners, dyes, pigments or fluorescent whitening agents.

According to the process of the invention, a firm but elastic fabric is obtained which can be used, in particular, for the manufacture of sportswear articles, windcheaters and ski jackets, ski suits, anoraks, coats, especially raincoats, industrial clothing, protective suits and sleeping bags. The laminated fabrics of this invention is also of importance in the automobile industry for interior finishing, especially roofing. The laminated material has almost the same elasticity as the starting material. The elasticity is especially pronounced when using polyurethane-containing material. In addition, the laminated material has good heat insulation as well as permeability to air and/or water vapour, which can be influenced by the degree of foaming and the coating thickness of the laminating agent, and it has good to very good adhesion and a good handle which can be reinforced by the concurrent use of a fabric softener. When using stable foams with a relatively high content of component (d) (1.5 to 5% by weight), adhesion and handle are especially good and the permeability to air and/or water vapour is particularly evenly distributed over the entire surface of the laminated fabric. The material has good resistance to washing and dry cleaning. By using foamed polymers of the indicated kind, it is also possible to laminate openstructured woven and knitted goods by the process of this invention without having to fear that the laminating agent will strike through. The application of the process of this invention to virtually all kinds of textiles is also particularly advantageous.

In the following preparatory methods and Examples, parts and percentages are by weight.

PREPARATORY METHODS

Copolymer A

A monomer mixture consisting of 84% of n-butyl acrylate, 11% of acrylonitrile and 5% of acrylic acid is copolymerised in the presence of sodium 2-oxyoctadecanesulfonate as emulsifier and of potassium persulfate as catalyst, in aqueous emulsion in known manner. A milky white emulsion with a pH value of 5.0 and a solids content of 50% is obtained.

Copolymer $B_1$

A monomer mixture consisting of 76% of n-butyl acrylate, 19% of acrylonitrile, 2.5% of N-methylolacrylamide and 2.5% of acrylamide is copolymerised in the presence of an adduct of 1 mole of octylphenol and 40 moles of ethylene oxide as emulsifier, of potassium persulfate as catalyst and of a small amount of itaconic acid, in known manner, in aqueous emulsion. A milky white emulsion with a pH value of 5.0 and a solids content of 50% is obtained.

Copolymer $B_2$

An analogous emulsion is obtained using a monomer mixture consisting of 65% of n-butyl acrylate, 20% of 2-ethylhexyl acrylate, 10% of acrylonitrile, 2.5% of N-methylolacrylamide and 2.5% of acrylamide.

Copolymer C 0.2 part of triethanolamine, 0.1 part of isooctyl alcohol and 2.65 parts of 100% acrylic acid are added to a solution of 1.6 parts of sodium octadecaneoxysulfonate in 62 parts of distilled water.

With vigorous stirring a mixture of 39.6 parts of 2-ethylbutyl acrylate and 13.2 parts of acrylonitrile is allowed to run slowly into this mixture at 20° to 25° C. to form an emulsion. With stirring and under nitrogen, half of this emulsion is warmed to 65° C., and a solution of 0.1 part of potassium persulfate in one part of distilled water is then added rapidly. After the polymerisation has begun, the other half of the emulsion, to which a solution of 0.1 part of potassium persulfate in 1 part of water has likewise been added beforehand, is run into the reaction mixture in the course of 1 hour.

After all of the monomer emulsion has run in, the reaction mixture is heated slowly to 80° to 85° C. and polymerised for a further 2¾ hours. A very finely dispersed, stable, coagulate-free emulsion with a solids content of 50 to 51% is obtained.

Copolymer D

In the manner described in method C, 50.16 parts of isopropyl acrylate and 2.64 parts of acrylonitrile are emulsified in a solution of 1.6 parts of sodium octadecaneoxysulfonate in 77 parts of water, to which 2.65 parts of acrylic acid, 0.2 part of triethanolamine and 0.1 part of isooctyl alcohol have been added.

3.2 parts of carbon tetrachloride are added to half of this emulsion and the mixture is warmed to 55° C., with stirring and under nitrogen, in order to effect polymerisation. Polymerisation starts on the addition of 1 part of a 10% aqueous solution of potassium persulfate and, after the temperature has risen to 65° C., the other half of the above emulsion, which is likewise mixed with 1 part of 10% potassium persulfate solution, is introduced in the course of 35 to 40 minutes and the reaction mixture is then stirred for a further 1½ to 2 hours, with gradual warming to 75° to 85° C. A pure, stable, very finely dispersed emulsion with a polymer content of 40 to 41% is obtained.

Copolymer E

The procedure of method C is repeated, using 44.88 parts of isopropyl acrylate, 7.92 parts of acrylonitrile and 72 parts of water. A pure, stable, finely dispersed emulsion with a solids content of 43% is obtained.

Copolymer F

Using 42.24 parts of isopropyl acrylate, 10.56 parts of acrylonitrile and 65.5 parts of water in place of the amounts of these compounds indicated in method D and retaining the amounts of the other reactants indicated therein, the same procedure yields a pure, stable, finely dispersed emulsion with a solids content of 45%.

Copolymer G

In the manner described in method C, 31.68 parts of 2-ethylhexyl acrylate and 21.12 parts of acrylonitrile are emulsified in a solution of 1.6 parts of sodium octadecaneoxysulfonate in 55 parts of distilled water, to which 2.65 parts of 100% acrylic acid, 0.2 part of triethanolamine and 0.1 part of isooctanol have also been added. Polymerisation is carried out by the procedure described in method C. The resultant, very finely dispersed emulsion is virtually pure and stable and has a solids content of 50 to 51%.

Copolymer H

In the manner described in method C, 42.24 parts of isobutyl acrylate, 5.28 parts of acrylonitrile and 5.28 parts of benzyl acrylate are emulsified in a mixture of 1.6 parts of sodium octadecaneoxysulfonate, 0.2 part of triethanolamine, 0.1 part of isooctanol, 2.65 parts of acrylic acid and 55 parts of water and the emulsion is polymerised.

A very fine, stable emulsion with a solids content of 50 to 51% is obtained.

In the above Example, the benzyl acrylate can be replaced by tetrahydrofuryl acrylate, while retaining the other constituents.

Copolymer I

A mixture of 47.52 parts of isopropyl acrylate, 2.64 parts of acrylonitrile and 2.64 parts of acrylamide are emulsified in a mixture of 65.5 parts of distilled water, 1.6 parts of sodium octadecaneoxysulfonate, 2.65 parts of acrylic acid, 0.2 part of triethanolamine and 0.1 part of isooctyl alcohol, in the manner described in method C. Half of this emulsion is warmed to 55° C., under nitrogen and with stirring, and 1 part of a 10% aqueous solution of potassium persulfate is added. After polymerisation has commenced and the temperature has risen to 56° to 58° C., the other half of the monomer emulsion, which has been mixed with 1 part of 10% potassium persulfate solution, is added in the course of 1 hour. After addition of all of the emulsion, the reaction mixture is polymerised for a further 3 to 3½ hours at a temperature of 80° to 83° C.

A stable, finely dispersed, virtually pure synthetic resin emulsion of low viscosity and having a solids content of 45% is obtained.

Copolymer J

Method I is repeated using an identical amount of isobutyl acrylate instead of isopropyl acrylate and, in addition, using only 55 parts of water instead of 65.5 parts. A pure, finely dispersed, stable emulsion with a solids content of 50 to 51% is obtained.

Copolymer K

In the manner described in method C, a mixture of 44.88 parts of isobutyl acrylate, 7.92 parts of acrylonitrile and 2.64 parts of camphene is emulsified in 58 parts of water to which 1.6 parts of sodium octadecaneoxysulfonate, 0.2 part triethanolamine, 2.65 parts of acrylic acid and 0.1 part of isooctanol have been added. Polymerisation in half of this emulsion is initiated after warming to 63° to 65° C., under nitrogen and with stirring, by adding 1 part of 10% potassium persulfate solution, and the other half of the emulsion is then added at 70° C. in the course of 2 hours. After addition of all of the emulsion, a solution of 0.1 part of benzoyl peroxide in 0.8 part of benzene is added rapidly and the reaction mixture is polymerised for a further 4 hours at 80° to 85° C. The completely polymerised emulsion is sparged in the customary manner with nitrogen and then cooled to room temperature.

The pure, finely dispersed emulsion of the copolymer is stable and has a solids content of about 50%.

Copolymer L

In the manner described in method C, 51.75 parts of isopropyl acrylate, 0.52 part of allyl acrylate and 0.52 part of acrylonitrile are emulsified in a solution of 1.6 parts of sodium octadecaneoxysulfonate in 60 parts of distilled water, to which 2.65 parts of acrylic acid, 0.2 part of triethanolamine and 0.1 part of isooctanol have been added. In order to effect polyperisation, half of the emulsion is warmed to 57° to 58° C., in a nitrogen atmosphere and with stirring, and 1 part of a 10% aqueous solution of potassium persulfate is added. After the temperature has risen to 64° C., the other half of the emulsion, which has been mixed with 1 part of a 10% aqueous solution of potassium persulfate, is added in the course of 1 hour and the reaction mixture is then polymerised for a further 3 hours at 83° to 85° C.

The finely dispersed, low viscosity emulsion is stable and has a solids content of 48 to 50%.

Copolymer M 42.24 parts of isopropyl acrylate, 5.28 parts of isobornyl allyl ether and 5.28 parts of acrylonitrile are emulsified by the procedure of method C in a solution of 1.6 parts of sodium octadecaneoxysulfonate in 75 parts of distilled water, to which 2.65 parts of acrylic acid, 0.2 part of triethanolamine and 0.1 part of isooctanol have been added. Polymerisation is effected in the manner described in method C, except that, after addition of all the emulsified monomers, polymerisation is brought to completion in the course of 3½ hours at 85° to 88° C.

The resultant emulsion is of low viscosity, finely dispersed, pure and stable.

Copolymer N

In the manner described in method C, 46.93 parts of isopropyl acrylate and 5.87 parts of acrylonitrile are emulsified in a solution of 1.6 parts of sodium octadecaneoxysulfonate in 75 parts of water, to which 2.65 parts of methacrylic acid, 0.2 part of triethanolamine and 0.1 part of isooctanol have been added. In order to effect polymerisation, half of the emulsion is warmed to 65° to 68° C., in a nitrogen atmosphere and with stirring, and 0.5 part of a 10% aqueous solution of potassium persulfate is added. After the temperature has risen to 75° C., the other half of the emulsion, which has been mixed with 1.5 parts of a 10% aqueous solution of potassium persulfate, is added in the course of 1 hour and the reaction mixture is then polymerised for a further 3 hours at 81° to 85° C.

The finely dispersed emulsion, which is of low viscosity, is stable and has a solids content of 46 to 47%.

Copolymer O

A monomer mixture consisting of 80% of n-butyl acrylate, 10% of acrylonitrile and 10% of acrylic acid is copolymerised in the same way as described in method A.

An emulsion with a pH value of 5.0 and a solids content of 50% is obtained.

Copolymer P

A monomer mixture consisting of 85% of isobutyl acrylate, 10% of acrylonitrile and 5% of acrylic acid is copolymerised in the same way as described in method A.

An emulsion with a pH value of 5.0 and a solids content of 50% is obtained.

Copolymer Q

A monomer mixture consisting of 76% of n-butyl acrylate, 19% of vinyl acetate, 3.5% of N-methylolacrylamide and 1.5% of maleic anhydride is copolymerised in known manner in the presence of sodium alkyl lauryl polyether sulfate as emulsifier and a small amount of sodium vinyl sulfate as well as a redox catalyst consisting of iron(II) sulfate, tert-butyl-hydroperoxide and sodium formaldehyde sulfinate. The pH of the milky-white emulsion is adjusted to 5–6 (solids content: 45%).

Copolymer R

A monomer mixture consisting of 47.5% of n-butyl acrylate, 47.5% of vinyl acetate, 2% of N-methylol allyl carbamate, 2% of N-methylolacrylamide and 1% of acrylamide is copolymerised in known manner in the presence of an adduct consisting of 1 mole of octyl phenol and 40 moles of ethylene oxide as emulsifier, a small amount of 2-acrylamido-2-methylpropanesulfonic acid and a redox catalyst consisting of iron(II) sulfate, tert-butyl hydroperoxide and sodium formaldehyde sulfinate. The milky-white emulsion is adjusted to a pH of 5–6 and has a solids content of 45%.

Copolymer S

69% of vinyl acetate, 26% of ethylene, 4% of N-methylol allyl carbamate and 1% of acrylamide are polymerised in known manner, under pressure, in the presence of an adduct consisting of 1 mole of nonyl phenol and 9 moles of ethylene oxide as catalyst, and a redox system consisting of iron(II) sulfate, potassium persulfate and sodium formaldehyde sulfinate. The milky-white emulsion is adjusted to a pH of 5–6 and has a solids content of 45%.

Copolymer T

63% of vinyl acetate, 32% of ethylene, 4% of N-methylol allyl carbamate and 1% of acrylamide can be polymerised in the same manner as copolymer S to give a copolymer having a solids content of 50% and a pH value of 5–7.

Copolymer U

A monomer mixture consisting of 65% of n-butyl acrylate, 20% of n-methylolacrylamide which is partially etherified with ethanol, and 15% of acrylonitrile is copolymerised in aqueous ethanolic emulsion in the presence of an alkylphenol polyglycol ether as emulsifier, potassium persulfate as catalyst and a small amount of itaconic acid. A finely dispersed, stable emulsion with a solids content of 52 to 53% is obtained.

EXAMPLE 1

A polyamide/polyurethane (85:15) knitted fabric is coated with a foam of the composition described below by means of a doctor blade, in one application and at a speed of 10 m/minute (coating thickness: 2.0 mm). A cotton/polyurethane (90:10) knitted fabric is then bonded wet and tensionless to the coated fabric and immediately afterwards the bonded fabrics are passed into a heating channel and dried at 100° C. The dry add-on of polymer is 135 g/m$^2$. The fabric issuing from the drying channel and having a residual moisture content of 10% is cooled to room temperature and pressed cold between two rollers, and then condensed for 30 seconds at 180° C. This last operation can be combined with an impregnation in order to improve the wearing characteristics, for example the handle or the water-repellent and/or oil-repellent properties. A textile laminate with very good strength and elasticity is obtained.

A foam having a weight per liter of 150 g and of the following composition: 1,000 parts of the 45% aqueous copolymer dispersion $B_2$, 35 parts of aminoplast resin (60% aqueous solution of dimethylolurea etherified with $CH_3OH$ and hexamethylolmelamine in a weight ratio of 4:1), 10 parts of 40% aqueous sodium lauryl sulfate, 2 parts of hydroxyethylcellulose, 15 parts of 25% aqueous ammonia, 75 parts of 30% aqueous ammonium stearate and 20 parts of water, is fed continuously to the coating unit with the aid of a foaming apparatus of the Hansa-Mixer-Junior type (Hansa Werke, Bremen).

The other copolymers can also be employed analogously for the preparation of foams.

EXAMPLE 2

A polyester/polyurethane (85:15) knitted fabric is coated with a foam of the composition described below by means of a doctor blade, in one application and at a speed of 6 m/minute (coating thickness: 1.55 mm). A cotton/polyurethane (90:10) knitted fabric is then bonded wet and tensionless to the coated fabric and immediately afterwards the bonded fabrics are passed into a heating channel and dried and simultaneously condensed at 160° C. The dry add-on of polymer is 80 g/m$^2$. The fabric issuing from the drying tunnel is cooled to room temperature and rooled up without pressing. Condensation is then brought to completion as described in Example 1 and, once again as described in Example 1, this last operation can be combined with an impregnation.

A textile laminate (weight: 460 g/m$^2$) with particularly high permeability to air and water vapour is obtained. Permeability to air: 60–80 l/second/m$^2$, permeability to water vapour: 40–60 g of water/m$^2$/hour.

A foam having a weight per liter of 120 g and of the following composition: 1,000 parts of the 45% aqueous copolymer dispersion $B_2$, 35 parts of a 60% aqueous solution of dimethylol-dihydroxyethylene urea, 10 parts of 40% aqueous sodium lauryl sulfate, 5 parts of hydroxyethylcellulose, 15 parts of 25% aqueous ammonia, 75 parts of 30% aqueous ammonium stearate and 45 parts of water, is fed continuously to the coating unit with the aid of the foaming apparatus in Example 1.

EXAMPLE 3

A polyamide/polyurethane (94:6) woven fabric is coated with a foam of the composition described below, by means of a doctor roller as described in Example 1.

A woven fabric having the same fibre composition is bonded wet and tensionless to the first fabric, and immediately afterwards the bonded fabrics are dried, cooled and pressed cold, as described in Example 1. The dry add-on of polymer is 135 g/m$^2$. Finishing is carried out as described in Example 1. A foam (weight per liter 150 g) of the composition described in Example 2 is fed continuously to the coating unit with the aid of the foaming apparatus mentioned in Example 1.

An elastic textile laminate with good permeability to water vapour and air is obtained.

EXAMPLE 4

A polyamide/polyurethane (80:20) knitted fabric is coated with a foam of the composition described below by means of a doctor blade, in one application and at a speed of 15 m/minute (coating thickness: 1.5 mm). A cotton terry knitted fabric is then bonded wet and tensionless to the coated fabric and immediately afterwards the fabrics are passed into a heating channel and dried at 100° C. The dry add-on of polymer is 100 g/m$^2$. The fabric issuing from the drying tunnel and having a residual moisture content of 10%, is cooled to room temperature and pressed cold between two rollers. Condensation is then brought to completion as described in Example 1. This process step can be combined with an impregnation.

A foam having a weight per liter of 150 g and of the following composition: 1000 parts of the 50% aqueous copolymer dispersion $B_1$, 25 parts of pentamethylolmelamine etherified with methanol, 10 parts of 40% aqueous sodium lauryl sulfate, 5 parts of hydroxyethylcellulose, 15 parts of 25% aqueous ammonia, 75 parts of 30% aqueous ammonium stearate and 45 parts of water, is fed continuously to the coating unit with the aid of the foaming apparatus mentioned in Example 1.

A laminated fabric (weight: 540 g/m$^2$) is obtained which has high elasticity and good permeability to water vapour and air. Permeability to water vapour: 20–30 g of water/m$^2$/hour, permeability to air: 15–25 l/second/m$^2$.

EXAMPLE 5

A polyester knitted fabric (velours, 110 g/m$^2$) dyed with disperse dyes is coated with a foam of the composition described below by means of a doctor blade, in one application and at a speed of 8 m/minute (coating thickness: 1.5 mm). A cotton/polyester knitted fabric (35:65) is then bonded wet and tensionless to the coated fabric and immediately afterwards the bonded webs are passed into a heating channel and dried at 100° C. The dry add-on of polymer is 130 g/m$^2$. The still hot fabric issuing from the drying channel and containing 10% of residual moisture is pressed between two non-heated rollers. The goods are then padded with an aqueous liquor (pick-up 60%) which contains, per liter, 25 g of a 30% aqueous emulsion of a perfluorinated polymer as oil repellent, 20 ml of isopropanol and 1.5 ml of 80% acetic acid, and subjected to a heat treatment at 170° C. for 60 seconds. The resultant laminated fabric has very good strength, is impermeable to air but permeable to water vapour, and in addition has oil-repellent and dirt-repellent properties.

With the aid of the foaming apparatus of Example 1, a foam having a weight per liter of 250 g and of the following composition is fed continuously to the coating unit: 1000 parts of the 45% aqueous copolymer dispersion R, 10 parts of 40% aqueous sodium lauryl sulfate, 5 parts of hydroxyethylcellulose, 15 parts of 25% aqueous ammonia, 75 parts of 30% aqueous ammonium stearate and 45 parts of water.

The foam can also be prepared using an aminoplast resin (e.g. a 50% aqueous solution of a mixture of dimethylol ethylene urea and a modified methylolmelamine in the weight ratio 7:3).

EXAMPLE 6

A bleached cotton woven fabric is coated with a foam of the composition described below by means of a doctor blade, in one application and at a speed of 20 m/minute (coating thickness: 1.0 mm). A second web of the same bleached cotton fabric is then bonded wet and under low tension to the coated fabric and immediately afterwards the bonded webs are passed into a heating channel and dried at 100° C. The dry add-on of polymer is 100 g/m$^2$. The dried fabric is cooled to room temperature and pressed cold between two rollers. The cotton laminate is then slop-padded with an aqueous liquor (pick-up 70%) which contains, per liter, 40 g of a fatty acid modified hexamethylolmelamine hexamethyl ether as water repellent, 2.5 g of aluminium triglycolate as curing catalyst and 25 g of a 40% aqueous emulsion of a pentachlorophenol ester as microbicide. The goods are then dried at 100°–120° C. and subjected to a heat treatment at 150° C. for 4 minutes. The resultant laminated fabric has very good permeability to air and water vapour and in addition has water-repellent and mildew-resistant properties.

With the aid of the foaming apparatus of Example 1, a foam having a weight per liter of 160 g and of the following composition is fed continuously to the coating unit: 1000 parts of the 50% aqueous copolymer dispersion A, 35 parts of aminoplast resin (70% aqueous solution of dimethylol-dihydroxy ethylene urea, pentamethylolmelamine tetramethyl ether and of an adduct of urea, isobutyraldehyde, formaldehyde and methanol in the weight ratio 30:13:27), 10 parts of 40% aqueous sodium lauryl sulfate, 15 parts of 25% aqueous ammonia, 75 parts of 30% aqueous ammonium stearate and 50 parts of water.

EXAMPLE 7

A polyamide fabric dyed with acid dyes (140 g/m$^2$) is coated with a foam of the composition described below by means of a doctor blade, in one application and at a speed of 10 m/minute (coating thickness: 1.0 mm). A polyester nonwoven (insulating felt) having a thickness of 10 mm is then bonded wet and tensionless to the coated fabric and immediately afterwards the bonded webs are passed into a heating channel and dried at 100° C. The dry add-on of polymer is 95 g/m$^2$. The dried fabric is cooled to room temperature and pressed cold between two rollers and then condensed for 30 seconds at 180° C. The resultant textile laminate has very good strength, good permeability to air and water vapour, and, in addition, good heat insulating properties.

With the aid of the foaming apparatus of Example 1, a foam having a weight per liter of 155 g and of the following composition is continuously fed to the coating unit: 1000 parts of the 53% aqueous copolymer dispersion U, 35 parts of aminoplast resin (dimethylol glyoxyl monourein etherified with methanol), 10 parts of 40% aqueous sodium lauryl sulfate, 8 parts of a thickener based on polyacrylic acid, 20 parts of 25% aqueous ammonia and 75 parts of 30% aqueous ammonium stearate.

The foam can also be prepared in analogous manner by using equal amounts of 40% aqueous monoethanol ammonium lauryl sulfate and dimethyl- or diethylaminoethanol fatty acid salts instead of sodium lauryl sulfate and ammonium stearate respectively.

EXAMPLE 8

A polyamide/polyurethane (80:20) knitted fabric is coated with a foam of the composition described below by means of a doctor blade, in one application and at a speed of 10 m/minute (coating thickness: 2.0 mm). A cotton jersey knitted fabric is then bonded wet and tensionless to the coated fabric and immediately afterwards the bonded webs are passed into a heating channel and dried at 100° C. The dry add-on of polymer is 140 g/m$^2$. The fabric issuing from the drying channel and containing 10% of residual moisture is cooled to room temperature and pressed cold between two rollers. Then an aqueous liquor which contains, per liter, 40 g of an aqueous emulsion with paraffin of montane wax and a chromium complex salt as water repellent, 30 g of a 20% aqueous emulsion of a perfluorinated polymer as oil repellent, and 1 ml of 80% acetic acid, is sprayed onto the laminate (pick-up 65%). The goods are then dried at 120° C. and subjected to a heat treatment at 150° C. for 3 minutes. The resultant laminated fabric (510 g/m$^2$) has good strength, high elasticity, good permeability to air and water vapour, and, in addition, good oil- and water-repellent properties. Not only the textile fabric but also the polymer layer in the foam coat has the water-repellent properties.

With the aid of the foaming apparatus of Example 1, a foam having a weight per liter of 150 g and of the following composition is fed continuously to the coating unit: 1000 parts of the 45% aqueous copolymer dispersion $B_2$, 35 parts of a 75% aqueous solution of glyoxyl monourein (anticrease agent), 200 parts of a 18% aqueous emulsion with paraffin of hexamethylolmelamine hexaethyl ether (water repellent), 20 parts of a 15% aqueous solution of a mixture of coconut fatty acid diethanolamide, fatty alcohol polyethylene glycol ethers and fatty acid polyethylene glycol esters (foaming agents and stabilisers), 15 parts of 25% aqueous ammonia, 80 parts of 30% aqueous ammonium stearate and 20 parts of water.

EXAMPLE 9

A polyamide staple fabric (140 g/m$^2$) is coated with a foam of the composition described below by means of a doctor blade, in one application and at a speed of 20 m/minute (coating thickness: 1.0 mm). A second web of the same fabric is then bonded wet and tensionless to the coated fabric and immediately afterwards the bonded webs are passed into a heating channel and dried at 100° C. The dry add-on of polymer is 115 g/m$^2$. The dried fabric is cooled to room temperature and pressed cold between two rollers. The laminate is then padded with an aqueous liquor (pick-up 60%) which contains, per liter, 60 g of a silicone preparation as water repellent, 9 g of a zirconium fatty acid derivative (20%) as curing catalyst, and 2 ml of 80% acetic acid, and then subjected to a heat treatment at 150° C. for 5 minutes. The resultant laminated fabric has good strength, good permeability to air and water vapour, and, in addition, good water repellent properties and a pleasing handle.

With the aid of the foaming apparatus of Example 1, a foam having a weight per liter of 215 g and of the following composition is fed continuously to the coating unit: 1000 parts of the 45% aqueous copolymer dispersion S, 15 parts of a 15% aqueous solution of a mixture of polyoxyethylene 2-cetyl ether and coconut fatty acid dimethylolamide in the weight ratio 4:1 (foaming agent and stabiliser), 25 parts of a 18% aqueous solution of a mixture of coconut fatty acid dimethylolamide and 9 moles of ethylene oxide and of lauryl triglycol ether sulfate in the weight ratio 10:12:7 (foaming agent and wetting agent), 3 parts of hydroxyethylcellulose, 15 parts of 25% aqueous ammonia, 80 parts of 30% aqueous ammonium stearate and 27 parts of water.

The foam can also be prepared in analogous manner by using 1000 parts of the 50% aqueous copolymer dispersion T.

EXAMPLE 10

A glass fibre fabric is coated with a foam of the composition described below by means of a doctor blade, in one application and at a speed of 8 m/minute (coarint thickness: 1.5 mm). A flame-proofed cotton knitted fabric (flame-retardant employed: 3-dimethylphosphono-propionic acid methylolamide) is then bonded wet and tensionless to the coated fabric and immediately afterwards the bonded webs are passed into a heating channel and dried at 100° C. The dry add-on of polymer is 100 g/m$^2$. The fabric issuing from the drying channel and containing 10% residual moisture is cooled to room temperature and pressed cold between two rollers, then condensed for 30 seconds at 180° C. The resultant laminated fabric has good permeability to air and water vapour and, in addition, is provided with a permanent flame-retardant finish.

With the aid of the foaming apparatus of Example 1, a foam having a weight per liter of 150 g and of the following composition is fed continuously to the coating unit: 1000 parts of the 45% aqueous copolymer dispersion $B_2$, 35 parts of a 75% aqueous solution of glyoxal monourein (anticrease agent), 120 parts of decabromodiphenyl oxide (flame-retardant), 10 parts of 40% aqueous sodium lauryl sulfate, 0.5 part of hydroxyethylcellulose, 15 parts of 25% aqueous ammonia, 75 parts of 30% aqueous ammonium stearate and 10 parts of water.

EXAMPLE 11

A polyester fabric steamed with aluminium (200 g/m$^2$) is coated with a foam of the composition described below by means of a doctor blade, in one application and at a speed of 20 m/minute (coating thickness: 1.5 mm). A cotton/polyester (67:33) fabric (120 g/m$^2$) is then bonded wet and under low tension to the coated fabric and immediately afterwards the bonded fabrics are passed into a heating channel and dried at 100° C. The dry add-on of polymer is 90 g/m$^2$. The dried fabric is cooled to room temperature and pressed cold between two rollers. The laminate is then padded with an aqueous liquor (pick-up 50%) which contains, per liter, 30 g of a 26% aqueous emulsion in perchloroethylene of a dimethyl polysiloxane and a polyethylene wax in the weight ratio 2.8:1 as fabric softener, dried at 100°–120° C. and subjected to a heat treatment at 150° C. for 4 minutes. The resultant laminated fabric is impermeable to light and heat reflecting, and, in addition, has a good handle.

With the aid of the foaming apparatus of Example 1, a foam having a weight per liter of 130 g and of the following composition is fed continuously to the coating unit: 1000 parts of the 45% aqueous copolymer dispersion $B_2$, 50 parts of aminoplast resin (50% aqueous solution of dimethylol ethylene urea and a modified methylolmelamine in the weight ratio 7:3), 5 parts of 2-amino-2-methyl-1-propanol hydrochloride (curing catalyst), 150 parts of titanium dioxide, 10 parts of a black pigment dye for textile printing, 2 parts of hydroxyethylcellulose, 20 parts of 25% aqueous ammonia, 60 parts of 30% aqueous ammonium stearate, and 100 parts of water.

EXAMPLE 12

The procedure of Example 1 is repeated using a foam of the following composition: 1000 parts of the 45% aqueous copolymer dispersion $B_2$, 35 parts of a 75% aqueous solution of glyoxal monourein (anticrease agent), 10 parts of a 38% aqueous solution of monoethanolammonium lauryl sulfate (foaming agent), 2 parts of a powdered thickener based on cellulose, 75 parts of a 35% solution of ammonium stearate and ammonium nitrate in the weight ratio 5.7:1 (stabiliser), 15 parts of 25% aqueous ammonia, and 20 parts of water.

The resultant laminated fabric has the properties indicated in Example 1.

Similar results are obtained if the foam is prepared from one of the 3 following formulations:

(1) Analogous preparation substituting 1000 parts of the 50% aqueous copolymer dispersion $B_1$ for the 45% copolymer dispersion $B_2$.

(2) 1000 parts of the 45% aqueous copolymer dispersion $B_2$, 35 parts of a 75% aqueous solution of glyoxal monourein (anticrease agent), 10 parts of a 38% aqueous solution of monoethanol ammonium lauryl sulfate (foaming agent), 2 parts of powdered thickener based on cellulose, 75 parts of a 35% solution of ammonium stearate and ammonium nitrate in the weight ratio 5.7:1 (stabiliser), 200 parts of a 18% aqueous emulsion with paraffin of hexamethylolmelamine hexaethyl ether (water repellent), 15 parts of 25% aqueous ammonia, and 20 parts of water.

(3) 1000 parts of the 45% aqueous copolymer dispersion R, 35 parts of a 75% aqueous solution of glyoxal monourein (anticrease agent), 10 parts of a 38% aqueous solution of monoethanol ammonium lauryl sulfate (foaming agent), 3 parts of a powdered thickener based on cellulose, 75 parts of a 35% solution of ammonium stearate and ammonium nitrate in the weight ratio 5.7:1 (stabiliser), 15 parts of 25% aqueous ammonia, 50 parts of water.

What is claimed is:

1. A process for the continuous production of laminated elastic fabrics having good permeability to air and/or water vapour, which process comprises coating a first web of fabric in the tensionless state with a foamed aqueous preparation which contains ($a_1$) a self-crosslinking acrylate-based copolymer,
($a_2$) a self-crosslinking vinyl-acrylate copolymer or
($a_3$) a self-crosslinking olefin-vinyl copolymer,
(b) optionally a curable, crosslinking, polyfunctional aminoplast precondensate or aminoplast former,
(c) a surface-active foaming agent,
(d) a stabiliser,
(e) optionally a wetting agent,
(f) optionally a thickener, and
(g) an amine or alkanolamine containing 1 to 4 carbon atoms or ammonia, bonding a second web of fabric, optionally under low tension, to the coated side of the first web, then drying and optionally pressing both webs together and finally subjecting them to a thermosetting treatment.

2. A process according to claim 1 for the production of laminated elastic fabrics having good permeability to air and water vapour, which process comprises coating the first web of fabric with an aqueous preparation which contains ($a_1$) a self-crosslinking acrylate-based copolymer,
(b) a curable, crosslinking polyfunctional aminoplast precondensate,
(c) a surface-active foaming agent,
(d) a stabiliser,
(e) optionally a wetting agent,
(f) optionally a thickener, and
(g) ammonia, and bonding the second web of fabric tensionless to the coated side of the first web of fabric.

3. A process according to claim 1, wherein component ($a_1$) is a copolymer of (1) 50 to 95 percent by weight of at least one acrylic acid ester containing 1 to 8 carbon atoms in the ester radical,
(2) 1 to 40 percent by weight of acrylonitrile,
(3) 2 to 10 percent by weight of an ethylenically unsaturated aliphatic dicarboxylic acid containing 4 to 6 carbon atoms, of an ethylenically unsaturated aliphatic monocarboxylic acid containing 3 or 4 carbon atoms and/or of the optionally methylated N-methylolamide of these monocarboxylic acids, and
(4) 0 to 20 percent by weight of another compolymerisable, unsaturated compound which differs from components (1), (2) and (3).

4. A process according to claim 1, wherein component ($a_2$) is a copolymer of (1) 20 to 95% by weight of at least one methacrylic acid ester or acrylic acid ester containing 1 to 8 carbon atoms in the ester radical,
(5) 5 to 80% by weight of a copolymerisable vinyl ester of an organic acid containing 1 to 18 carbon atoms,
(6) 0 to 10% by weight of at least one optionally methylolated compound of the formula I which can be etherified with alkanols containing 1 to 8 carbon atoms $$CH_2{=}\overset{R_1}{\overset{|}{C}}{-}A{-}B{-}[{-}R_2{-}O{-}]_{n-1}{-}\overset{O}{\overset{\|}{C}}{-}NH_2 \qquad (I)$$

wherein $R_1$ is hydrogen or methyl, A is methylene or —CO—, B is a direct bond, —O— or —NH—, $R_2$ is alkyl of 2 to 4 carbon atoms, and n is an integer from 1 to 11, and (7) 0 to 10% by weight of another copolymerisable compound differing from components (1), (5) and (6), or 50 to 90% by weight of the indicated component (5), 0 to 10% by weight of the indicated component (6), and 10 to 40% by weight of an olefin as component (8).

5. A process according to claim 1, wherein component (b) is a methylolated, free or etherified urea, ethylene urea or melamine or is glyoxal monourein, component (c) is an optionally ethoxylated fatty alcohol containing 4 to 18 carbon atoms in the alkyl moiety, an alkylarylsulfonic acid containing 4 to 18 carbon atoms in the alkyl moiety, an alkylsulfonic acid or alkylsulfate each containing 8 to 24 carbon atoms, a fatty alcohol or $C_4$–$C_{12}$ alkylphenol-ethylene oxide adduct containing 5 to 100 ethylene oxide units or an alkali metal salt or ammonium salt thereof, component (d) is an ammonium or amine salt of a fatty acid containing 8 to 24 carbon atoms or a fatty acid-alkanolamine reaction product, component (e) is an ethoxylated $C_8$–$C_{24}$fatty alcohol or $C_4$–$C_{12}$alkylphenol containing 1 to 9 ethylene oxide units, and component (f) is an unmodified or modified cellulose, polyvinyl alcohol, alginate, locust bean gum or a synthetic thickener based on polyacrylate.

6. A process according to claim 1, wherein the first web of fabric is coated with the foamed aqueous preparation by means of a doctor blade to a thickness of 0.5 to 3 mm, said coating operation and the subsequent wet bonding of the second web of fabric being carried out in the temperature range from 15° to 40° C.

7. A process according to claim 1, wherein the webs of fabric are dried at temperatures up to 100° C., then pressed together at a linear pressure of 5 to 15 kg/m$^2$, and finally cured in the temperature range from 100° to 180° C.

8. A process according to claim 1, wherein the webs of fabric are dried at temperatures up to 160° C. and subsequently cured at temperatures up to 180° C.

9. A process according to claim 1, wherein the webs of fabric are impregnated with agents for improving the wearing characteristics before curing.

10. A foamed aqueous preparation for carrying out the process according to claim 1.

* * * * *